US005988537A

United States Patent [19]

Marra

[11] Patent Number: 5,988,537

[45] Date of Patent: Nov. 23, 1999

[54] APPARATUS AND METHOD FOR CONTROLLED IMPACT COMMINUTION OF WOOD

[75] Inventor: Alan A. Marra, Amherst, Mass.

[73] Assignee: Forest Products Development Laboratories, Inc. L.L.C., Amherst, Mass.

[21] Appl. No.: 09/082,802

[22] Filed: May 21, 1998

[51] Int. Cl.[6] ..... B02C 23/12

[52] U.S. Cl. ..... 241/28

[58] Field of Search ..... 241/19, 24.29, 241/27, 58, 79.1, 189.1, 194

[56] References Cited

U.S. PATENT DOCUMENTS

| | | |
|---|---|---|
| 1,636,033 | 1/1927 | Agnew . |
| 1,669,239 | 5/1928 | Grindle . |
| 2,882,149 | 4/1959 | Willems . |
| 3,065,919 | 11/1962 | Burkett et al. . |
| 3,329,350 | 7/1967 | Wisgerhof et al. . |
| 3,794,251 | 2/1974 | Williams . |
| 3,899,139 | 8/1975 | Okada et al. . |
| 4,087,052 | 5/1978 | Rohrbach . |
| 4,701,294 | 10/1987 | Radwanski et al. . |
| 4,816,075 | 3/1989 | Gruenewald . |
| 5,472,147 | 12/1995 | Doppstadt . |

OTHER PUBLICATIONS

"Williams Hot HOg Shredders" Bulletin 871.

Hawkensen Enterprises brochure: Schutte Model 1390 Wood Grinder Hammermill.

*Primary Examiner*—David A. Scherbel

*Assistant Examiner*—Anthony Ojini

*Attorney, Agent, or Firm*—Mary M. Moyne; Ian C. McLeod

[57] ABSTRACT

A method and apparatus (10) for the controlled impact comminution of wood pieces (100) is described. The apparatus includes a housing (12) within which is located a comminuting chamber (14). The acceleration zone (14A) of the chamber has an impeller system (36) with flails (42). A fan (54) is also mounted adjacent the lower portion of the chamber. The comminution zone (14B) of the chamber includes first and second impact plates (26 and 30) and a funnel (34) having an outlet tube (34B) which is connected by a tube (56) to the inlet (54A) of the fan. The outlet (54B) of the fan is connected by an outlet chute (58) to a cyclone collector (60) positioned over a bin (62). To comminute the wood pieces, the pieces are fed into the impeller path (44). The flails of the impeller move the pieces around the path and accelerate the pieces into contact with the impact plates. As a result of the impact, the pieces are reduced into smaller pieces. Depending on the weight of the pieces, the pieces either reenter the impeller path for further comminution or if the pieces have been reduced to a predetermined size the pieces are drawn upward and out of the chamber through the outer tube to the cyclone collection and the bin by the fan.

17 Claims, 3 Drawing Sheets

APPARATUS AND METHOD FOR CONTROLLED IMPACT COMMINUTION OF WOOD

BACKGROUND OF THE INVENTION (1) Field of the Invention

The present invention relates to a method and apparatus for producing wood particles or fibrous elements of a uniform size from wood pieces through impact comminution controlled by separating extraction mechanics from disintegrating mechanics. In particular, the present invention relates to a method and apparatus for comminuting wood pieces where the wood pieces are propelled by an impeller into contact with a first impact plate which causes cleavage of the wood pieces producing smaller wood pieces. Depending upon the weight of the remaining wood piece and the resulting wood pieces, the pieces are either impacted against a second plate for further comminution or are drawn upward out of the apparatus by a negative air flow mechanism.

In the lexicon of the smaller wood elements derivable from wood, the terms: flake, strand, splinter, sliver, fiber-bundle and fiber are associated with definite products into which they are composed. Each element contributes characteristics to the composite and to its processing in accordance with the element's geometry. The fibrous strand or fibrous element is a combination element being composed of both a strand-like element and fiber-like elements. The strand part may be straight but is usually bent or curved. The fibrous parts are partially cleaved appendages that branch off in random directions from the strand part.

Fibrous strands, like other wood elements, can be produced and have utility over a wide range of sizes. Fibrous strands are three-dimensional particles, compared to two-dimensional flakes, and one-dimensional slivers or splinters. Strands (actually narrow flakes) as used in Oriented Strand Boards (OSB) are strictly speaking, two-dimensional but are used in a one-dimensional manner (oriented) to create strength in a given direction.

The three-dimensional configuration of the fibrous strand contributes uniquely to its further processing and to the properties of the resulting composite material. Unlike flakes and other linear or flat elements that depose themselves parallel to the surface upon which they fall, fibrous strands assume a more random orientation. Thus, flakes contribute strength primarily in the x-y plane, leaving the z plane relatively weak. Fibrous strands, however, because of their more random orientation, produce substantially greater strength in the z plane. The z plane figures heavily in the performance of overlays and in the general integrity of the composite material.

Fibrous strands also compose themselves into a rather open but cohesive mat. Such a mat is easy to transport between operations, is easily infused with gases, liquids and powders, has less edge defects in pressing, produces strength perpendicular to faces, (high internal bond) and allows low, as well as high density composite materials to be made.

The three-dimensional configuration of fibrous strands confers versatility in consolidation to many types of products. Flat, molded or post-formed commodities or consumer products can be made, sometimes with the same composition. Properties are related to density which can range from about 8 pounds per cubic foot upward, depending upon the pressure applied during consolidation.

(2) Description of the Related Art

The related art has shown various types of comminuting apparatuses that involve hammermill action or impact action. Illustrative are U.S. Pat. Nos. 1,636,033 to Agnew; 3,065,919 to Burkett et al; 3,794,251 to Williams; 3,899,139 to Okada et al; 4,816,075 to Gruenewald and 5,472,147 to Doppstadt and also "Williams Hot Hog Shredders" Bulletin 871, and Hawkensen Enterprises brochure: Schutte Model 1390 Wood Grinder Hammermill.

Agnew describes an impact grinder which uses centrifugal force to throw the material radially outward at high velocity whereby the impact of the individual particles of the material against breaker rings causes the material to be shattered and pulverized into smaller sizes and extracted through a discharge spout at the bottom.

Burkett et al relates to a device for comminuting consolidated sedimentary rocks and recovering the mineral values therefrom. The machine includes a plurality of rapidly rotating, superimposed, axially-aligned discs which receive the conglomerate rock particles and throw them centrifugally and tangentially outward against an enclosing wall with an impact sufficient to comminute the particles into grains and to abrade, scour and polish the surfaces of the resulting grains to produce a valuable dust concentration which is constantly and permanently removed by downwardly flowing air.

Further, Williams and "Williams Hot Hog Shredders" Bulletin 871 show material reducing systems which use a positive air flow to move the particles through a venturi system to separate sizes.

Okada et al shows a hammermill where completely crushed matter is taken out through a screen below the hammermill and uncrushable matter is floatingly selected through ascending air currents and taken out of the housing through an exhausting route.

Gruenewald shows an apparatus for comminuting plant material for further processing. The apparatus includes an up front cutter and a shredder which are immediately adjoining and located at the end of an adjustable speed conveyor. The shredder is comprised of a series of beater tools. The shredder and up front cutter are covered by a material guide housing having several sections extending approximately vertically from the plane defined by the rotational axis of the cutter and shredder. The housing has a wall portion remote from the up front cutter and from the shredder which forms an impact and deflection baffle for the comminuted material ejected by the up front cutter for feeding this material to the shredder.

Doppstadt shows a comminuting machine having a rotary impact mechanism. A conveyor moves the material to the rotary impact mechanism which cooperates with an impact plate holding a sequence of teeth with decreasing clearance in disintegrating the material. The comminuted material is collected through comminuting grates adjacent the rotary impact mechanism.

The Hawkensen Enterprises brochure shows a wood grinder hammermill.

Also, of interest are U.S. Pat. Nos. 1,669,239 to Grindle; 3,329,350 to Wisgerhof et al and 4,087,052 to Rohrbach. Grindle shows a pulverizer for coal which uses a plurality of beating wheels of increasing diameter and thus increasing peripheral velocity to impact material against teeth for progressive disintegration. An air flow device is used to move the pulverized material from the machine through the exit port. Wisgerhof et al shows an apparatus for use in pulverizing rock using rotating blades that comminute material by combining cutting and impact. Extraction is effected through a lower port. Rohrbach describes an impact mill which stands vertically such that the grinding wheels of increasing diameter rotate horizontally at high peripheral speed to comminute friable material mainly by impact.

Only of minimal interest is U.S. Pat. No. 2,882,149 to Willems which shows a flow and mixing apparatus to improve efficiency of chemical or homogenization operations using a system of rotors and stators that produce pumping and shearing actions. Also, U.S. Pat. No. 4,701,294 to Radwanski et al which shows an apparatus for forming a fibrous web.

The art of disintegrating materials by impact forces has the general objective of reducing friable materials such as rock and coal and to some extent dry wood to a powdery or granular state. All of the currently known impact milling apparatuses introduce the material to be disintegrated at an infeed port and remove the disintegrated product through a discharge port. During transit, the material is usually subjected to increasing comminution until the final size has been reached at discharge. However, there are no means to interrupt the disintegration at intermediate stages and remove the product at some predetermined intermediate size. Moreover, it is not anticipated that these machines would accept high moisture content wood to produce a fibrous material. Without an efficient means of extracting fibrous material, which is in essence at an intermediate stage of comminution, the system becomes clogged. As a result, high moisture content wood is not a desirable feed for impact milling processes.

There remains the need for an apparatus and method for controlled impact comminution of wood pieces to produce fibrous elements from wood materials which uses an impeller to propel the wood pieces against impact plates and uses a negative air flow mechanism to remove the resulting particles or elements from the apparatus as soon as the particles or elements reach a desired size. Further, there remains a need for a wood comminuting apparatus which will permit the utilization of waste or unwanted wood to produce fiber-based, value-added products, thus providing another tool for managing our wood supply on a more sustainable and environmentally favorable basis.

OBJECTS

It is therefore an object of the present invention to provide an apparatus which allows for controlled impact comminution of wood pieces to form wood particles or fibrous elements having a uniform size. Further, it is an object of the present invention to provide a method of forming wood particles having an upper and lower size limit using controlled comminution and extraction of wood pieces. Still further, it is an object of the present invention to provide an apparatus which uses negative air flow to remove wood particles of a desired size to prevent further reduction in size of the wood particles. Further still, it is an object of the present invention to provide an apparatus with a pair of impact plates, judiciously disposed so as to disintegrate wood pieces propelled against them. It is further an object of the present invention to provide a method of impact comminuting of high moisture content wood to form fibrous particles. Further, it is an object of the present invention to provide a method for producing wood particles from wood pieces which retain the natural grain direction and therefore, the innate strength conferred by the species. Still further, it is an object of the present invention to provide a method for comminuting wood pieces where the resulting wood particles, having a predetermined size, are removed from the comminuting chamber as soon as the particles are formed to prevent additional reduction of the particles.

These and other objects will become increasingly apparent by reference to the following drawings and the description.

DETAILED DESCRIPTION OF THE PREFERRED EMBODIMENTS

The present invention relates to an apparatus for comminuting larger pieces to smaller particles, which comprises: a housing having a top and a bottom with an inner chamber spaced therebetween having an inlet chute for introducing wood pieces into the inner chamber and an outlet adjacent the top of the housing; an impeller means mounted in the inner chamber of the housing adjacent the bottom of the housing including flails pivotable and rotatable about a shaft; impact plates mounted in the inner chamber of the housing between the top of the housing and the impeller means; and an air flow means for moving air from the inner chamber and through the outlet of the housing to remove the particles of a predetermined size from the housing and the apparatus.

Further, the present invention relates to a method for producing smaller particles from larger pieces, which comprises the steps of: providing an apparatus including a housing having a top and a bottom with an inner chamber spaced therebetween having an inlet chute for introducing larger pieces into the inner chamber and an outlet adjacent the top of the housing; an impeller means mounted in the inner chamber of the housing adjacent the bottom of the housing including flails pivotable and rotatable about a shaft; impact plates mounted in the inner chamber of the housing between the top of the housing and the impeller means; and an air flow means for moving air from the inner chamber and through the outlet of the housing to remove the particles of a predetermined size from the housing and the apparatus; introducing larger pieces into the apparatus using the inlet chute while the impeller means and the air flow means are activated wherein the impeller means impinges the larger pieces against the impact plates to produce the particles; and collecting the particles of a predetermined size from the outlet of the housing.

Figure 1:
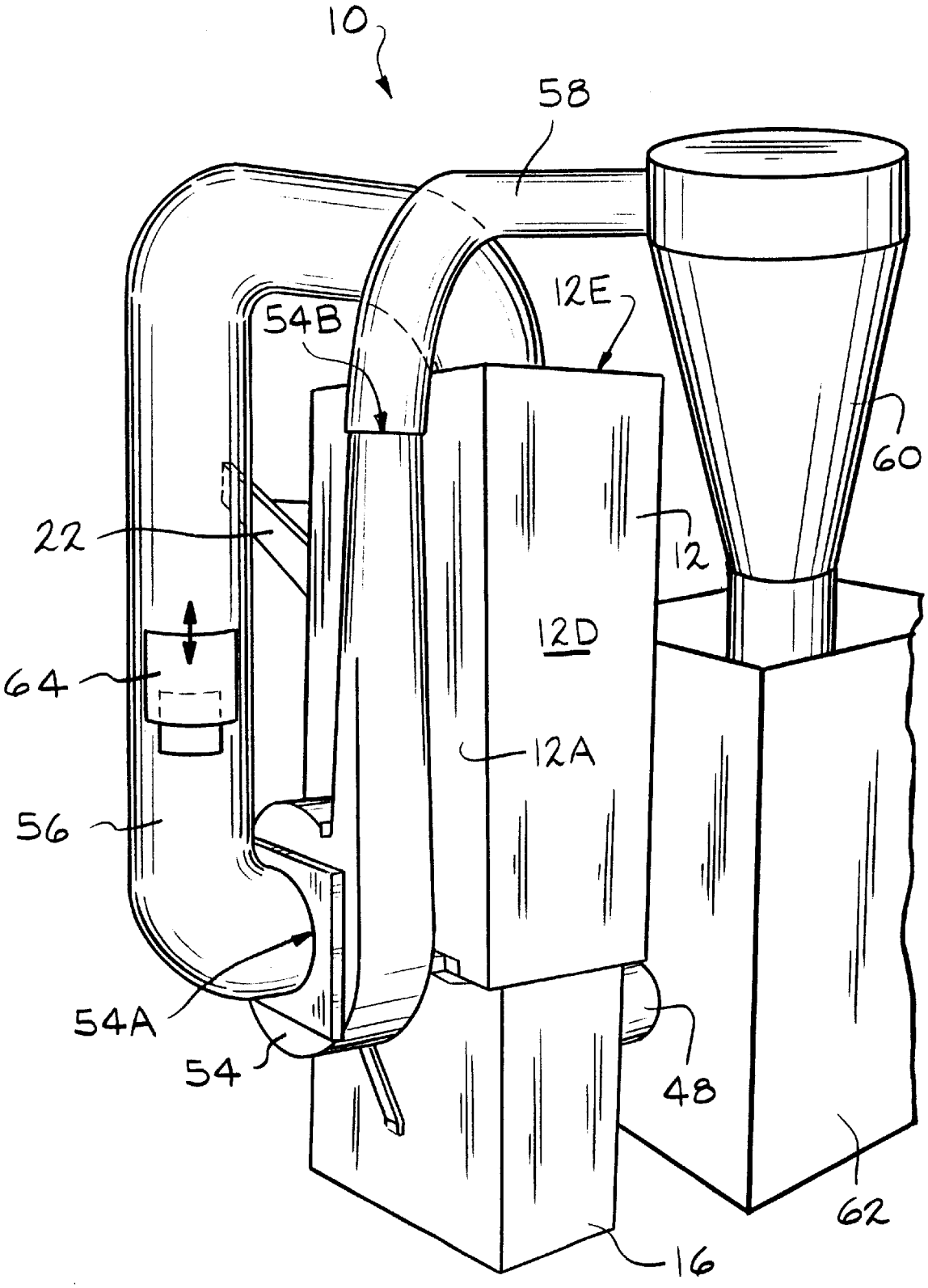
FIG. 1 is a front perspective view of the apparatus 10 showing the housing 12, the fan 54, the feed trough 22 and the outlet chute 58.
Figure 2:
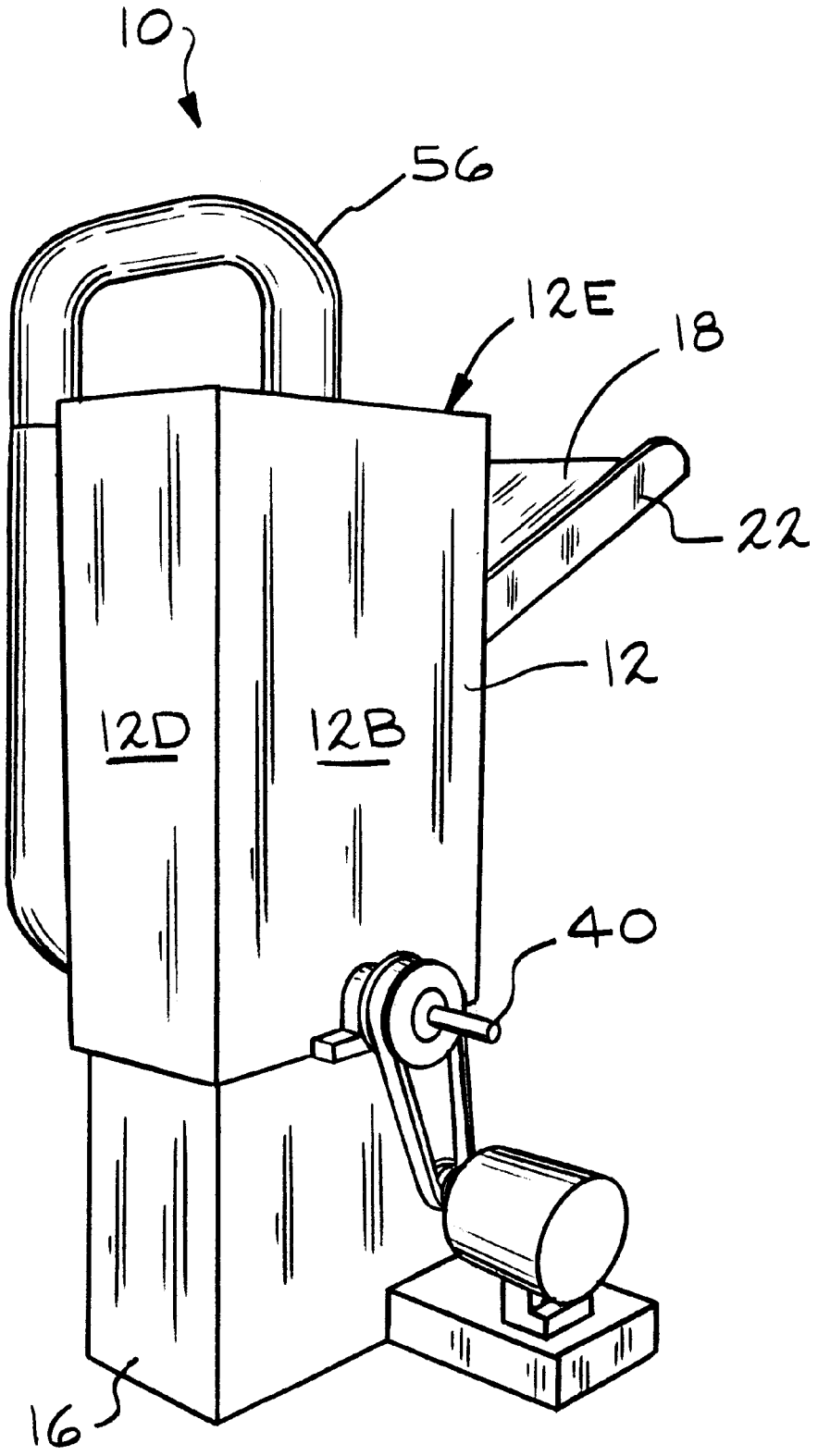
FIG. 2 is a rear perspective view of the apparatus 10 without the outlet chute 58, cyclone collector 60 or collection bin 62 showing the housing 12 and the feed chute 18.
Figure 3:
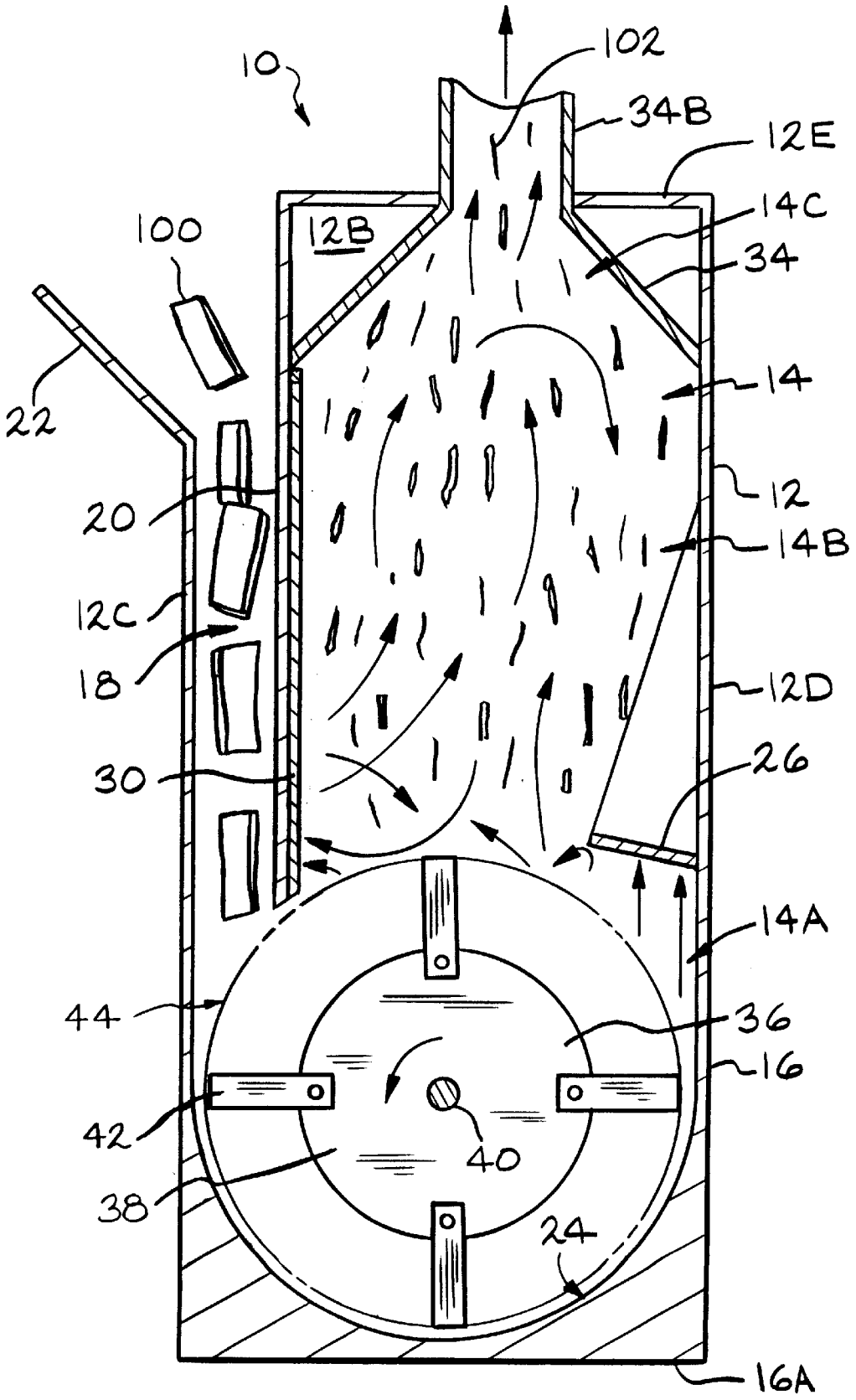
FIG. 3 is a front cross-sectional view of the housing 12 of the apparatus 10 showing the comminuting chamber 14, the first and second impact plates 26 and 30, the impeller system 36 and having arrows showing the possible paths of the infeed wood pieces 100 and exiting wood particles 102.

FIGS. 1 and 2 show the comminuting apparatus 10 of the present invention. The apparatus 10 can be used to comminute a variety of materials. In the preferred embodiment, the material is wood. The apparatus 10 is composed of three vertically positioned sections or zones 14A, 14B and 14C: a lower section or accelerator zone 14A which is structurally and operationally similar but functionally different from a conventional hammermill with flailing hammers or flails 42 to impart velocity to entering wood pieces 100 and a fan 54 to provide air flow for controlling comminution and extracting exiting particles 102 based on size; a middle section or comminution zone 14B containing impact plates 26 and 30 against which wood pieces 100 are shattered; and an upper section or classification and extraction zone 14C where competing gravitation and levitation forces control the comminution. The apparatus 10 includes a housing 12 having a front wall 12A, a back wall 12B, right and left sidewalls 12C and 12D and a top wall 12E. The housing 12 preferably has a rectangular shape with a rectangular cross-section. The housing 12 is mounted on a base 16 which has a bottom wall 16A. The base 16 holds the impeller system 36 and the fan 54. The housing 12 is removable from the base 16 for maintenance purposes. The housing 12 and the base 16 form an inner comminuting chamber 14. A feed chute 18 is located along the left sidewall 12C of the housing 12 and is formed by the left sidewall 12C and an inner sidewall 20 spaced apart and parallel to the left sidewall 12C (FIG. 3). The inner sidewall 20 preferably extends downward from the top wall 12E of the housing 12 toward the bottom wall 16A of the base 16 and ends slightly spaced above the impeller path 44 at the bottom of the housing 12 such that the impeller system 36 is able to freely rotate without contacting the inner sidewall 20. However, preferably, the inner sidewall 20 is of such a length as to prevent incoming pieces 100 from entering too high up on the impeller path 44. In the preferred embodiment, the feed chute 18 extends the entire width of the housing 12. The upper end of the feed chute 18 preferably has a feed trough 22 which allows the user to feed pieces 100 uniformly into the feed chute 18.

The inner comminuting chamber 14 is comprised of three zones, the accelerator zone 14A, the impact or comminution zone 14B and the classification and extraction zone 14C. The accelerator zone 14A of the chamber 14 is located at the bottom of the chamber 14 and is provided with an impeller system 36 and a fan 54 positioned outside the chamber 14. In the preferred embodiment, the impeller system 36 is similar in structure to a conventional hammermill being comprised of a system of flails or impellers 42 pivotably mounted on a series of discs 38 (one shown) which is rotatably mounted on a shaft 40. However, the flails 42 could be mounted in a variety of different ways that provide a flexible swing. Each disc 38 preferably has several flails 42 spaced apart around the circumference of the disc 38. The pivotable mounting of the flails 42 on the discs 38 allows the impeller system 36 to accommodate a variety of different sized and shaped entering wood pieces 100. The impeller system 36 is preferably similar to hammermills which are well known in the art. Although, the impeller system 36 is similar to that typically found on conventional hammermills, the flails 42 preferably act to move and accelerate the wood pieces 100 into contact with the impact plates 26 and 30 to splinter the wood pieces 100, rather than disintegrating the wood pieces 100 and depositing them through the perforations of a grate as with conventional hammermills. As shown in FIG. 3, the floor 24 of the comminuting chamber 14 is imperforate, and arcuate in shape such as to correspond to the circumference of the impeller path and providing a smooth path for the wood pieces 100 to be accelerated toward the impact plates 26 and 30.

As in conventional hammermills, the fan 54 is mounted on the same shaft 40 as the impeller system 36 but can be separately driven. However, in contrast to conventional hammermills, air flow is redirected so it draws from the top of the apparatus 10 rather than the bottom. To accomplish this, the inlet 54A of the fan 54 is connected by a tube 56 to the outlet tube 34B of the funnel 34 (to be described in detail hereinafter). The outlet 54B of the fan 54 is connected by an outlet chute 58 to a cyclone collector 60 which is connected to a collection bin 62 (FIG. 1). However, any type of well known collection means can be used. The tube 56 connected to the inlet 54A of the fan 54 is preferably provided with a variable vent 64 to regulate the amount of airflow to the fan 54. Preferably, the fan 54 is a paddle fan or a wing fan which does not damage the particles 102 when the particles 102 are moved through the fan 54 for collection.

The comminution zone 14B of the comminuting chamber 14 is preferably provided with first and second impact or buttress plates 26 and 30. The faces of the plates 26 and 30 are positioned so as to be essentially perpendicular to a tangential trajectory of the wood pieces 100 being propelled by the impeller system 36. The first impact plate 26 is mounted on the inside surface of the right sidewall 12D of the housing 12 above the impeller path 44 (FIG. 3). The first impact plate 26 preferably extends inward from the right sidewall 12D about 4.5 inches (11.4 cm). The plate 26 is mounted slightly above the impeller path 44 such as to not interfere with rotation of the impeller system 36. In the preferred embodiment, the plate 26 is mounted so as to provide a clearance of 2.0 inches (5.1 cm) from the outermost path 44 of the flails 42. The plate 26 preferably has an angle upward from the plane perpendicular to the tangential trajectory of the wood pieces 100 coming off the impeller system 36. This angle is provided so that after impact, particles 102 can either slide off or reenter the impeller path 44 for another impact without interfering with oncoming wood pieces 100. The plate 26 along with its back support is preferably removably mounted to the side wall 12C or 12D of the housing 12 to allow for easy removal in order to make changes for wear, orientation or surface texture.

The second impact plate 30 is preferably mounted on the inner sidewall 20 and extends upward toward the top wall 12E of the housing 12. The second impact plate 30 is preferably parallel and in contact with the inner sidewall 20. In an alternate embodiment (not shown), the second impact plate 30 is angled such that the upper end of the plate 30 is spaced apart from the inner sidewall 20. The second impact plate 30 extends the entire width of the housing 12 of the apparatus 10. In the preferred embodiment, the second impact plate 30 is also removably mounted which enables easy replacement of the plate 30 for wear, orientation or change of texture. In the preferred embodiment, the impact plates 26 and 30 are constructed of 0.25 inch (0.64 cm) thick tread plate steel. The surface of the impact plates 26 and 30 is provided with a texture to increase the frictional resistance between the plates 26 and 30 and the wood pieces 100 which increases the comminuting effectiveness of the plates 26 and 30.

The classification and extraction zone 14C of the chamber 14 is located above the comminution zone 14B adjacent the top wall 12E of the housing 12. The classification and extraction zone 14C is provided with a funnel 34 which is mounted adjacent the top wall 12E of the housing 12 and extends through an opening (not shown) in the top wall 12E of the housing 12. The funnel 34 spreads across the entire width and length of the upper chamber 14 and acts to direct air and particles 102 into the outlet tube 34B of the funnel 34.

In Use:

To operate the apparatus 10 to produce fibrous wood particles 102, the impeller system 36 and the fan 54 are activated and the wood pieces 100 are fed through the feed trough 22 into the feed chute 18 and into the accelerator chamber 14A of the comminution zone 14. As the wood pieces 100 enter the accelerator zone 14A, the wood pieces 100 are engaged tangentially by the flails 42 of the impeller system 36 and accelerated around and along the floor 24 of the comminuting chamber 14 and upward along the right sidewall 12D of the housing 12 to impinge against the first impact plate 26. The wood pieces 100 are swept along the circular floor 24 and upward toward the impact plate 26. The high speed impact of the wood pieces 100 against the first impact plate 26 causes the wood pieces 100 to shatter. After impact against the first impact plate 26, the resulting shattered pieces either rebound back into the path of the rotating flails 42 of the impeller system 36 or are moved upward by the negative airflow as wood particles 102, depending on the size and weight of the shattered pieces 100 (FIG. 3). If the pieces 100 are too large or too heavy, the pieces 100 are drawn downward by gravity to be reengaged by the flails 42 and moved further along the impeller path 44 and impacted against the second impact plate 30. If the pieces 100 have been reduced to the particles 102 are wood particles 102 are carried upward and out through the funnel 34 by the negative airflow created by the fan 54. The process of impacting the wood pieces 100 against the second impact plate 30 or wafting the wood particles 102 upward is repeated until all pieces 100 have been reduced to the desired size. Control of the comminuting process is achieved by establishing an environment within the comminuting chamber 14 wherein negative airflow caused by the fan 54 (suction) competes with gravity to separate acceptable fibrous elements or particles 102 that are immediately wafted out of the chamber 14 from wood pieces 100 that are still too heavy and are thus, drawn by gravity back down into the comminution zone 14B for further reduction.

As the wood particles 102 are moved upward by the negative airflow, the funnel 34 at the top of the housing 12 directs the particles 102 into the outlet tube 34B. The particles 102 travel through the outlet tube 34B into the tube 56 to the fan 54. The particles 102 are then moved through the fan 54, through the outlet chute 58, through the cyclone collector 60 and finally into the collection bin 62.

The type and size of the particle 102 being produced depends on several factors including size and prior treatment of the entering wood pieces 100 in conjunction with the speed of rotation of the impeller system 36 and the strength of air flow which is dependent on the speed of the fan 54. The speed of the impeller system 36 is the basic means of varying the intensity of impact. For example, at 1200 RPM a mild reduction or comminution action occurs while at 1750 RPM the reduction action is more aggressive. In the preferred embodiment, because the impeller system 36 and the fan 54 are driven by the same shaft 40 and have the same RPM, the speed of the impeller system 36 is preferably left constant and the comminution is controlled by the air velocity alone. The strength of the air flow is adjusted with the variable vent 64 while comminution is in progress. The variable vent 64 permits varying the strength of the suction imposed on the forming fibrous elements 102 and thus, controls the degree of comminution. The air flow rate produced by the fan 54 governs both the comminution and the extraction process. The particles 102 which are produced are smaller at lower air flow rates than at higher air flow rates.

The first and second impact plates 26 and 30 are preferably removable to adjust for wear, angle or texture. The angle of the impact plates 26 and 30 with respect to the trajectory of the wood pieces 100 has a bearing on the quality of the impact. The impact is more aggressive as the angle approaches perpendicular and less aggressive as the angle becomes more parallel. Impact plates 26 and 30 are removably mounted to the housing 12 should changes in angle be necessary to change aggressiveness of impact. The amount of impact necessary to achieve the desired wood pieces 100 depends on the amount and nature of pretreatments given incoming wood pieces 100. For example, crushing or steaming before comminution would permit a less aggressive impact action to be effective. The optimum angle for the plates 26 and 30 varies depending on the qualities of the wood pieces 100 such as species, size and pretreatment. An angle of about 12° from the horizontal for the first impact plate 26 provides the optimum compromise for maximum impact and appropriate rebound to the next action. Decreasing the angle provides a more aggressive impact. Increasing the angle eases the impact. In the preferred embodiment, the second impact plate 30 is vertically orientated to provide a similar impact/rebound angle with respect to the trajectory of the wood pieces 100. The vertical orientation of the second impact plate 30 provides a rebound angle that favors an upward bounce and thus, promotes flight of the particles 102 or pieces 100 upward to determine acceptability for removal. Declination of the second impact plate 30 results in greater breakdown of the wood pieces 100, since the pieces 100 would tend to rebound back toward the impeller system 36, subverting the elevation forces of the fan 54 and thus, allowing additional impacts. Preferably, the plates 26 and 30 are orientated to ensure that after impact, the resulting particles 102 enter the classification and extraction zone 14C as soon as possible to separate out those particles 102 that are of the desired size and need to be extracted by the air flow system from those pieces 100 which are still too heavy and are drawn downward by gravity into the flail path 44 for further reduction.

The texture of the surface of the impact plates 26 and 30 also has a bearing on the movement and comminution of the wood pieces 100. The texture of the surface of the impact plates 26 and 30 affects the flow of the particles 102 over the surface of the plates 26 and 30. Slight intermittent elevations in the surface of the plates 26 and 30 reduce sliding of the wood pieces 100 and particles 102 on the surface of the plates 26 and 30 which produces a more aggressive impact. For example, a smooth surface provides less impact than a rough surface. A rough surface reduces sliding action and therefore, has an effect similar to reducing the impact angle. A surface normally textured for tread plate such as ridges in a herringbone design or dome-like protrusions reduces but does not obstruct the flow of particles 102 after impact. In the preferred embodiment, the plates 26 and 30 have dome-like protrusions on their surfaces.

The apparatus 10 allows for controlling the size and to a certain extent the configuration of the particles 102 produced. The apparatus 10 of the present invention can be used to comminute high moisture content wood. The ability to process high moisture content wood, in contrast to other impact machines, provides the means for producing fibrous particles 102. This is because wood of high moisture content tends to cleave more readily along the grain, whereas dry wood tends to reduce to granular particles under impact. Cleavage along the grain produces the highest strength particle because the original strength of the wood is largely preserved to be recaptured in the composite. The differential cleavage that occurs when high moisture wood is broken by such actions as impacting, crushing, tearing, or shearing usually leads to fibrous appendages on particles that are produced. To a certain extent therefore, the degree of fiberization can be modified by moisture content and also by temperature. Some species of wood have inherent properties that affect the fibrous nature of a comminuted product. Two structurally similar species, red oak and white oak for example break down in markedly different ways; the red oak produces stick-like elements while the white oak produces fibrous elements under the same breakdown conditions. In addition, depending upon the species and pretreatment of the wood pieces 100, the apparatus 10 may produce linear type particles or curvilinear particles. The length of the particles 102 produced tends to be essentially the same as the length of the wood pieces 100 from which the particle 102 was produced. Long wood pieces produce long particles and vice versa.

The process of controlled impact comminution was described primarily with regard to wood. However, the apparatus and method can be used for controlled comminution of other breakable materials as well.

It is intended that the foregoing description be only illustrative of the present invention and that the present invention be limited only by the hereinafter appended claims.

I claim:

1. An apparatus for comminuting larger wood pieces to smaller fibrous particles, which comprises:

(a) a housing having a top and a bottom with an inner chamber spaced therebetween having an inlet chute for introducing larger wood pieces into the inner chamber and an outlet adjacent the top of the housing;

(b) an impeller means mounted in the inner chamber of the housing adjacent the bottom of the housing including flails pivotable and rotatable about a shaft wherein the impeller means acts to move and accelerate the larger wood pieces in a trajectory path;

(c) an impact plate mounted in the inner chamber of the housing such that the outlet of the housing is spaced between the inlet chute and the impact plate and between the top of the housing and the impeller means wherein the larger wood pieces are moved by the impeller means into contact with the impact plate such that the contact of the larger wood pieces into the impact plate causes the larger wood pieces to be splintered to produce the smaller fibrous particles wherein some of the fibrous particles are of a predetermined size after contact with the impact plate and are immediately drawn out of the outlet; and (d) an air flow fan which provides controllable, negative air flow in the inner chamber for drawing air from the inner chamber through the outlet of the housing wherein the smaller fibrous particles of a predetermined size are removed from the housing and the apparatus primarily by the negative air flow created by the air flow fan wherein the negative air flow created by the air flow fan allows for controlling an amount of comminution by removing the fibrous particles from the trajectory path of the impeller means when the particles are of the predetermined size and allows for extraction of the fibrous particles from the housing.

2. The apparatus of claim 1 wherein there are two impact plates.

3. The apparatus of claim 2 wherein the impact plates are on opposed sides of the outlet of the housing and are positioned in a trajectory path of the propelled larger wood pieces.

4. The apparatus of claim 2 wherein the impact plates are removable and exchangeable.

5. The apparatus of claim 1 wherein the impact plate is spaced at least 180° apart from the inlet chute around the trajectory path in a direction of movement of the propelled larger wood pieces.

6. The apparatus of claim 1 wherein the impeller means is similar in structure to an impeller of a hammermill.

7. The apparatus of claim 1 wherein the air flow means is provided by a paddle fan.

8. The apparatus of claim 1 wherein the impact plate is positioned at an angle with respect to a trajectory of the larger wood pieces after contact with the impeller means.

9. The apparatus of claim 1 wherein an outlet tube having opposed ends is connected at one end to the air flow means and at the other end to the outlet of the housing such that air is drawn from the outlet of the housing to create a classifying environment therein.

10. The apparatus of claim 9 wherein a variable vent is provided in the outlet tube adjacent an inlet of the air flow means to regulate the amount of air flow.

11. The apparatus of claim 1 wherein the impact plate is textured to increase the effectiveness of the impact.

12. A method for producing smaller fibrous particles from larger wood pieces, which comprises the steps of:

(a) providing an apparatus including a housing having a top and a bottom with an inner chamber spaced therebetween having an inlet chute for introducing larger wood pieces into the inner chamber and an outlet adjacent the top of the housing; an impeller means mounted in the inner chamber of the housing adjacent the bottom of the housing including flails pivotable and rotatable about a shaft; an impact plate mounted in the inner chamber of the housing such that the outlet of the housing is spaced between the inlet chute and the impact plate and between the top of the housing and the impeller means; and an air flow fan which provides controllable, negative air flow in the inner chamber for drawing air from the inner chamber through the outlet of the housing wherein the smaller fibrous particles of a predetermined size are removed from the housing and the apparatus primarily by the negative air flow created by the air flow fan;

(b) introducing larger wood pieces into the apparatus using the inlet chute while the impeller means and the air flow means are activated wherein the impeller means moves and accelerates the larger wood pieces around a trajectory path without crushing or comminuting the larger wood pieces and then impinges the larger wood pieces against the impact plate to produce the smaller fibrous particles by splintering the larger wood pieces;

(c) using primarily the negative air flow to immediately extract the smaller fibrous particles from the outlet of the housing as soon as the particles are of a predetermined size while continuing to comminute the larger wood pieces which have a size greater than the predetermined size; and (d) collecting the smaller fibrous particles of the predetermined size from the outlet of the housing.

13. The method of claim 12 wherein the impact plates are removable and replaceable with plates having a different orientation to produce smaller fibrous particles of the predetermined size.

14. The method of claim 12 wherein there are two impact plates and wherein the impeller impacts the larger wood pieces against both of the plates at least once to produce the predetermined size of the smaller fibrous particles.

15. The method of claim 14 wherein the amount of impacts of the larger wood pieces against the plates is determined by the strength of the moving air produced by the air flow means.

16. The method of claim 12 wherein the smaller fibrous particles are produced by cleavage of the larger wood pieces along a grain of the larger wood pieces.

17. The method of claim 12 wherein the impact plate is removable and replaceable with plates having a different surface texture to produce smaller fibrous particles of the predetermined size.

* * * * *